United States Patent [19]

Henriksen et al.

[11] Patent Number: 4,882,995

[45] Date of Patent: Nov. 28, 1989

[54] PROJECTILE FOR DARTING GUN

[76] Inventors: Henrik M. Henriksen, Holmenveien 1, N-3130 Teie; Egil O. Oen, Vestbyveien 46, N-1440 Drobak, both of Norway

[21] Appl. No.: 300,321

[22] Filed: Jan. 23, 1989

Related U.S. Application Data

[63] Continuation-in-part of Ser. No. 96,339, Sep. 11, 1987, abandoned.

[51] Int. Cl.[4] ..... F42B 13/54

[52] U.S. Cl. ..... 102/371; 102/272; 102/275

[58] Field of Search ..... 102/371, 254, 258, 399, 102/272, 275

[56] References Cited

U.S. PATENT DOCUMENTS

| | | | |
|---|---|---|---|
| 2,619,905 | 12/1952 | Apothéloz | 102/272 |
| 2,659,273 | 11/1953 | Trautmann | 102/371 |
| 2,667,814 | 2/1954 | Blackman | 102/371 |
| 2,708,860 | 5/1955 | Arpin | 102/371 |
| 3,103,172 | 9/1963 | Hutchison et al. | 102/275 |
| 3,143,071 | 8/1964 | Arnold et al. | 102/275 |
| 3,351,018 | 11/1967 | Bedall | 102/275 |
| 3,580,172 | 5/1971 | Hendricks | 102/371 |
| 3,599,569 | 8/1971 | Heartness | 102/371 |
| 4,237,788 | 12/1980 | Hagen | 102/275 |
| 4,487,127 | 12/1984 | Lubbers | 102/272 |

*Primary Examiner*—David H. Brown
*Attorney, Agent, or Firm*—Frost & Jacobs

[57] ABSTRACT

A projectile for a darting gun, comprising a front head housing a front ignition plunger arranged for axial rearward movement when the tip of the projectile strikes a target, the ignition plunger communicating with a rearwardly extending striker means which in an uninfluenced position of the ignition plunger terminates at a first predetermined distance from an ignition time delay element, the ignition time element when triggered by the striker means being arranged to fire a detonator which in turn detonates a main charge arranged in a tubular body attached to the rear of the front head, a safeguarding means which can be influenced by an outer mechanical force, the safeguarding means in a first position holding the ignition time delay element at a second predetermined distance from the detonator, and in a second position allowing the ignition time delay element to travel the second predetermined distance so as to be brought in close enough communication with the detonator for the detonation thereof when said projectile penetrates into the body of a target. The safeguarding means is mounted rearwardly of the front ignition plunger, so that the ignition plunger will be influenced prior to the safeguarding means when the projectile hits the target and penetrates thereinto.

13 Claims, 4 Drawing Sheets

PROJECTILE FOR DARTING GUN

CROSS-REFERENCE TO RELATED APPLICATION

This application is a continuation-in-part of Ser. No. 07/096,339, filed Sept. 11, 1987, now abandoned in the name of of Henrik M. Henriksen.

FIELD OF THE INVENTION

The present invention relates to an arrangement in a projectile for a darting gun, said projectile comprising a front head, housing a front ignition plunger arranged for axial rearward movement when the tip of the projectile strikes a target, said ignition plunger communicating with a rearwardly extending striker means which in an uninfluenced position of said ignition plunger terminates at a first predetermined distance from an ignition time delay element, said ignition time delay element when triggered by said striker means being arranged to fire a detonator which in turn detonates a main charge arranged in a tubular body attached to the rear of said front head.

BACKGROUND OF THE INVENTION

The Greenland whale or Bowhead is one of the larger whale species. In Alaska the whaling thereof is restricted to a limited number, approximately twenty to thirty specimens per year by the local Inuit Eskimo population. The weapons which are used during the whaling are very primitive and have been subjected to only small changes during the last hundred years. The whaling takes place at the iceborder and then from boats made of skin and having a crew of six to ten men. The Bowhead is harpooned by means of a bomb lance or darting gun comprising a firing weapon attached to a rod and having a small harpoon affixed thereto. In the darting gun there is provided a projectile which is fired by means of a trigger rod when the darting gun with its harpoon hits the Bowhead, and the killing of the whale is effected by the main charge of the projectile which is detonated after having penetrated into the whale. To ensure that the whale is really killed, further projectiles may be fired from one or more separate guns. The projectiles of these old-fashioned darting guns suffer from the disadvantage that they do not carry a sufficient charge for a proper killing of such a large animal as a Bowhead, which can gain a weight of approximately 40 tons. This old-fashioned killing has therefore been subjected to critical voices, especially from wild-life protection societies.

Another disadvantage from which these darting guns suffer, is the lack of safety during transport, preparation and handling, and several accidents causing damages to the whalers have been encounted due to unintentional firing of the projectiles.

OBJECT OF THE INVENTION

An object of the invention is thus to provide a projectile for a darting gun which compared with prior art darting guns provide safer and more humane killing of Bowheads.

Another object of the invention is to provide a darting gun projectile which can separate the firing mechanism and the main charge during storage and transport. Yet another object of the invention is to provide a double security system in connection with the projectiles or darting guns, said double security system being dependent upon the correct sequence of operation which will only take place during a normal firing of the darting gun.

Still another object of the invention is to provide a projectile for a darting gun which can carry a larger main charge for a more efficient rapid and humane killing of the whale, whilst still preserving a great safety against unintentional or premature detonation of the main charge.

An object of the invention is also to provide an explosive charge arrangement which renders safe operation under all circumstances.

GENERAL DESCRIPTION OF THE INVENTION

The above objects are achieved in a projectile for a darting gun of the type referred to above, which is characterized by the fact that the ignition time delay element is arranged to be controlled by a safeguarding means which can be influenced by an outer mechanical force. The safeguarding means will in a first position hold said ignition time delay element at a second predetermined distance from said detonator, and in a second position allow said ignition time delay element to travel said second predetermined distance, so as to be brought in close enough communication with said detonator for the detonation thereof when said projectile penetrates into the body of a target.

It should be noted that said safeguarding means should be mounted rearwardly of said front ignition plunger, so that the ignition plunger will be influenced prior to said safeguarding means when the projectile hits the target and penetrates thereinto, so that said ignition time delay element is triggered before said safeguarding means is brought from its first position to its second position.

It should further be noted that the setting of the ignition time delay element should be larger than the stipulated time for the fired projectile to penetrate into the target, i.e. the time delay should not lapse prior to the displacing of the safeguarding means from its first position to its second position.

Another important feature of the present projectile is that said first predetermined distance between said striker means of the front ignition plunger and said ignition time delay element should be increased when said safeguarding means is moved to its second position, this increase in distance being larger then the travelling distance of the striker means of the front plunger to reach the ignition time delay element for the ignition thereof.

BRIEF DESCRIPTION OF THE DRAWINGS

The invention will now be further described, reference being had to the drawings which illustrate embodiments of prior art darting guns as well as a preferred embodiment of a projectile according to the present invention.

DETAILED DESCRIPTION OF THE INVENTION

In FIGS. 1, 2 and 3*a*–3*d* there is illustrated an embodiment of a prior art darting gun including a projectile, said darting gun arrangement being used by the Eskimo population in Alaska for catching the Greenland whale or Bowhead. As mentioned in the introductory part of the specification this weapon is very primitive and has not been changed very much for the last hundred years. It suffers primarly from the disadvantage that it cannot carry a sufficient charge for killing the Bowhead in a humane manner, since the charge is relatively small compared to this large animal weighing up to 40 tons.

Figure 1:
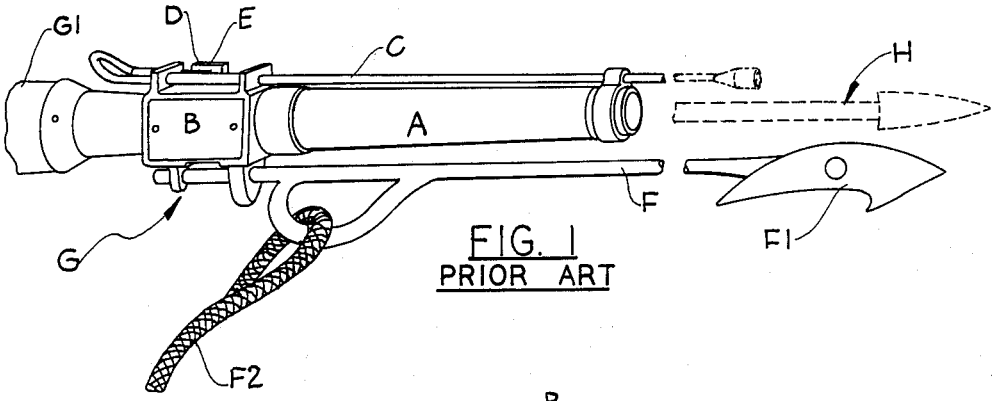
FIG. 1 PRIOR ART
FIG. 1 is a perspective side view of a prior art darting gun.

As indicated in FIG. 1 the prior art darting gun G comprises a barrel A, a receiver B, a trigger rod C, a safety pin D, a hammer cocking lever E and a harpoon rod F. At the front end of the harpoon rod F ther is attached a harpoon blade F1, whereas at the rear portion of said harpoon rod F there is attached a line F2.

At the end of the gun G there is attached a wood pole Gl serving as a buoyancy means in case the darting gun should be dropped in the water.

Figure 2:
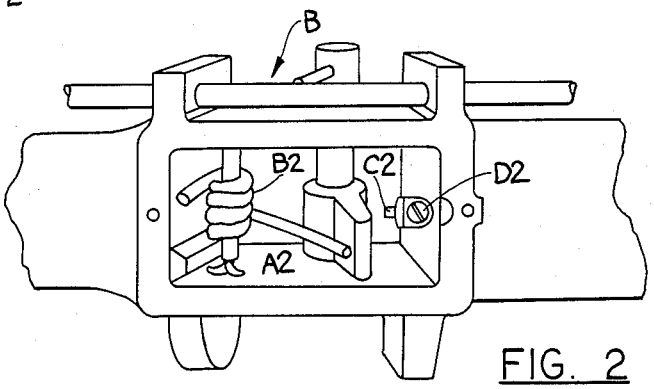
FIG. 2 PRIOR ART
FIG. 2 shows on an enlarged scale a perspective view of the receiver of the prior art darting gun of FIG. 1, with its side plates removed.
Figure 3A:
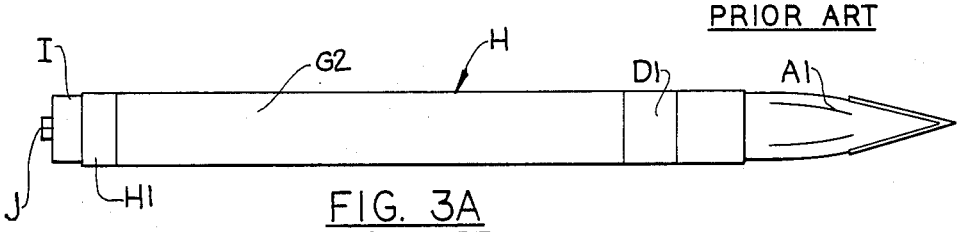
FIG. 3A PRIOR ART
FIGS. 3*a* to 3*d* illustrate a projectile for a prior art darting gun.
Figure 3B:
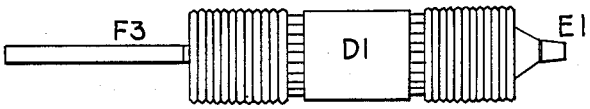
FIG. 3B PRIOR ART
Figure 3C:
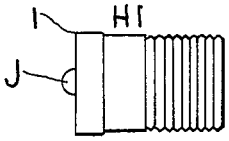
FIG. 3C PRIOR ART
Figure 3D:
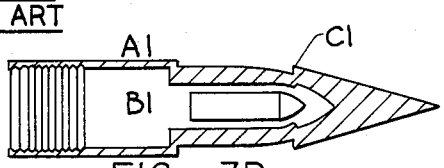
FIG. 3D PRIOR ART

The receiver B of the darting gun, as illustrated in Figure 2, comprises a hammer A2 on its pivot, a hammer spring B2 on its pivot, a firing pin C2, and a firing pin retaining screw D2.

In the barrel A there is provided an arrow or a projectile H which, as illustrated in FIGS. 3*a* to 3*d*, comprises a front end A1 containing a striker B1 which is held in position by means of a balsa stick C1. A threaded coupling D1 comprises a percussion cap nipple E1 as well as a copper fuse tube F3. A tubular body G2 is threaded at each end to accept the front coupling D1 and a base plug H1. The base plug H1 is terminated by a leather washer I which is attached by means of a screw J to the base plug H1.

After the firing of the shooting gun G the harpoon blade Fl will penetrate into the body of the whale and be attached under the hide of the whale. After a certain penetration of the whale blade Fl under the blubber of the whale, the trigger rod C will be activated, which in turn will trigger the firing mechanism in the receiver B of the darting gun G, as illustrated especially in FIG. 2.

The tubular body G2 of the projectile H is filled with approximately 50 grams of black powder or 30 grams of progressive powder. The firing of the powder takes place through a time delayed proximity fuse, which has a setting of three to four seconds. It should be noted that the projectile or the arrow is fired by drive charge comprising an appropriate amount of black powder. The projectile or the arrow is meant to effect the killing of the whale, and if necessary the darting gun projectile is followed by a separate projectile fired from a separate gun.

The above described prior art darting gun suffers, as indicated above, from several disadvantages, also relating to the fact that the safety mechanisms are insufficient for the primitive whaling conditions prevailing for the whalers in their tiny skin boats at the ice edges of the Alaska coast. Another disadvantage from which the prior art darting guns are suffering, is that they can carry only a limited explosive main charge for killing the whale, due to the poor safety measures included therein.

DESCRIPTION OF PREFERRED EMBODIMENT OF THE INVENTION

With reference to FIGS. 4 to 7 the following description will be given, relating to a preferred embodiment of the present projectile for a darting gun.

Figure 4:
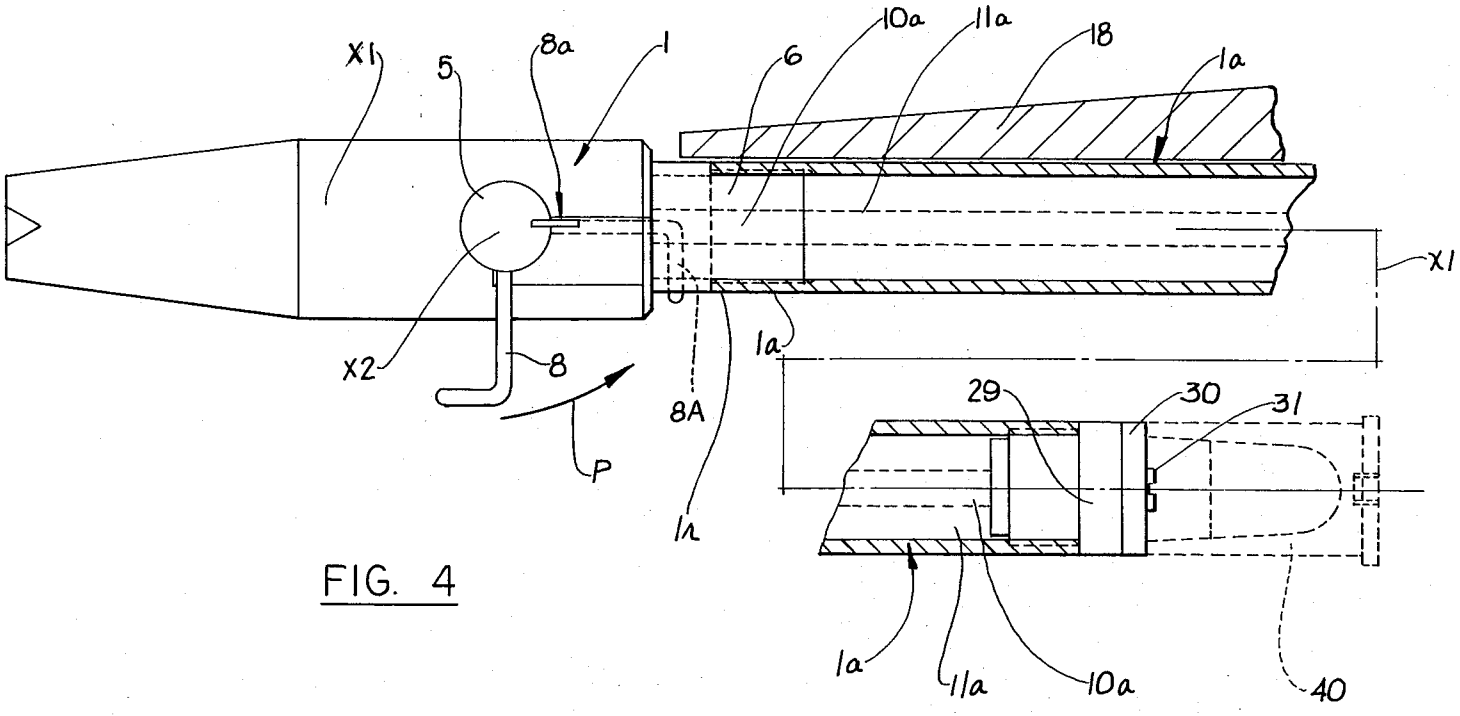
FIG. 4 is a side view partly in section of an embodiment of the projectile of a darting gun according to the present invention, said projectile being assembled for carrying a main charge in a tubular body.
Figure 5:
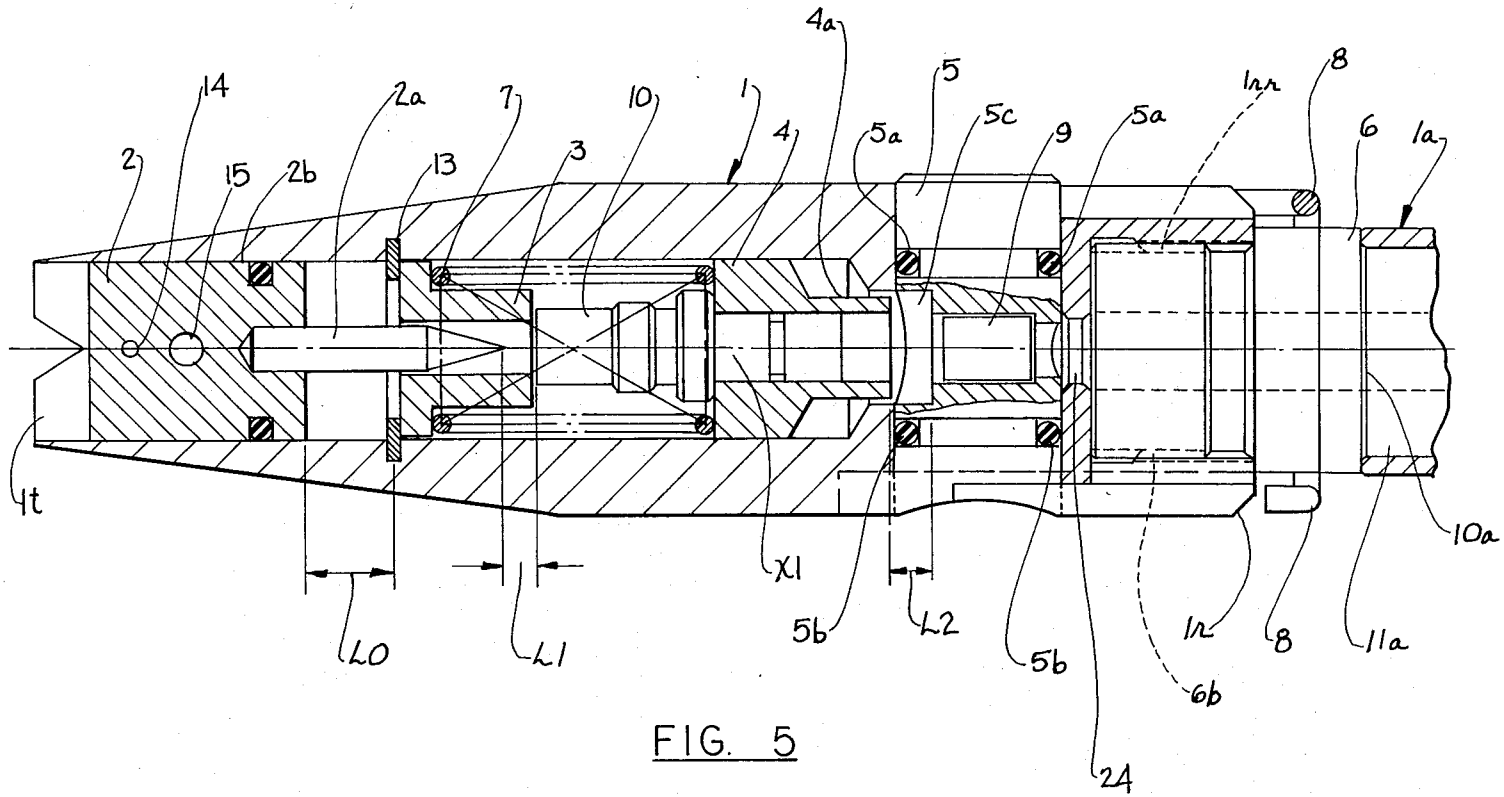
FIG. 5 is a longitudinal section through a top view of a preferred embodiment of the projectile according to the invention.

The whale arrow or projectile of a darting gun illustrated in FIGS. 4 and 5 is composed of two major or parts, i.e. on the one hand a firing mechanism, a detonator and a safeguarding means, all of which are housed in a front head which is generally designated by 1, and, on the other hand, a main charge which is housed in a tubular body la attached to the rear of said front head 1.

The front head 1 houses a front ignition plunger 2 having a cylindrical form and being arranged for axial rearward movement when the tip lt of the projectile head 1 strikes a target. The ignition plunger 2 is arranged in a cylindrical bore 2*b* and holds a rearwardly extending striker means 2*a* which in an uninfluenced position of said ignition plunger terminates with its pointed free end at a first predetermined distance L1 from an ignition time delay element 10.

The ignition time delay element 10 has a time delayed function in the range of 2.2 to 3.8 seconds, a range which of course can be changed according to the conditions ruling on site. The ignition time delay element 10 is arranged coaxially to the central axis X1 of the front head 1 and is arranged to fire a detonator 9 which is housed in a detonator housing 5, and which in turn is arranged to detonate a main charge 10*a*, 11*a* which is arranged in the tubular body 1*a* attached to the rear and 1*r* of said front head 1 by an intermediate connection piece 6.

The detonator housing 5 is made to rotate around a transverse axis X2, by means of appropriate O-rings 5*a* and 5*b*, said detonator housing 5 being able to rotate when being influenced by an outer, mechanical safeguarding means 8.

In FIG. 4 which illustrates the projectile in a side view, the safeguarding means 8, which takes the form of a hoop, is shown in its erected position, i.e. with its hoop-like structure protruding sideways out from the main surface of the front head 1. When this protruding hoop-like structure 8 is hit by an outer obstacle, it will be allowed to turn in the direction of the arrow P in FIG. 4, so as to merge with the outer surface of the front head 1, which position is illustrated with dotted lines 8*a* in FIG. 4, and also in FIG. 5, which is a top view of the front head 1. When the safeguarding means 8 is in the protruding position, as shown with solid lines in FIG. 4, the ignition time delay element 10 and its locking piece 4 are urged against a closed portion of the detonator housing 5 by a coiled spring 7, and will not move until the safeguarding means 8 mounted rearwardly of said front ignition plunger 2 is activated. This rearward mounting of the means 8 ensures that the ignition plunger 2 normally will be influenced prior to said safeguarding means 8 when the projectile 2 hits a target and penetrates thereinto, i.e. said ignition time delay element 10 will then be triggered before the safeguarding means 8 is turned down from its first protruding safety on position, which is illustrated in FIG. 4 at 8, to its second front head surface merging safety off position illustrated in FIG. 4 at 8A, and in FIG. 5.

In other words, the safeguarding means 8 will in its first safety on position hold the detonator housing 5 closed, so that said ignition time delay element 10 remains at a second predetermined distance L2 from the interior of said detonator 9, the distance L2 being too large for the ignition time delay element 10 to fire the detonator 9 in case the time delay element 10 should be ignited unintentionally. However, in its second safety off position the safeguarding means 8 will turn the detonator housing 5 approximately 90 degrees to bring a recess 5c thereof in line with the main axis X1, which will allow said ignition time delay element 10 to travel said second predetermined distance L2, so as to be brought in close enough communication with said detonator 9 for the detonation thereof after said projectile head 1 has penetrated into the body of the target.

To avoid any accidentially sudden travel of the striker means 2a of the front ignition plunger 2, a safety pin 14 has been arranged at the front of said head 1, so as to keep the ignition plunger 2 and its striker means 2a in a safe position, said safety pin 14 being dimensioned so as to be broken when the projectile hits the body of the target. In addition, the front head 1 is provided with a transport pin 15 keeping the ignition plunger 2 in a steady permanent position during transport and during the initial stage of preparation of the projectile on site.

It should be noted that the first predetermined distance Ll between the striker means 2a and the ignition time delay element 10 is increased beyond the distance Ll when the safeguarding means 8 is moved to its safety off position, because the time delay element 10 will then travel the distance L2. This increase in distance will thus correspond to the second predetermined distance L2, and the sum of L1 and L2 will be larger than the total travelling distance L0 of the striker means 2a to reach the ignition time delay element 10 for the ignition thereof. This means that the operation of the various devices in the projectile head 1 must take place in a correct sequence if the projectile is to fire the main charge 10, 11a housed in the tubular body 1a, and this sequence of operation contributes to the high degree of safety of the arrangement according to the present invention.

In order to keep the safeguarding means 8 in a protruding position the safeguarding means 8 is provided with a breaking device 8a, said breaking device 8a being ruptured when the safeguarding means 8 hits the target upon penetration of the head 1 thereinto.

The tubular body 1a which is attached to the intermediate connection piece 6 allows for a detachable mounting and easy replacement of the main charge in the tubular body la, the main charge preferably being a combination of detonating wicks, as this will be further discussed in connection with FIGS. 6, 6a and 7.

As illustrated in FIG. 4, the tubular body la is provided with wings 18 which renders a more stable trejactory to the arrow during its flight towards the target. In this Figure there is also illustrated a gun cartridge, to be fired in order to shoot the projectile against the target The means for urging the time delay element 10 against the safeguarding means 8, i.e. the coiled spring 7 arranged axially in said head 1 and surrounding said time delay element 10, is arranged between appropriate abutment faces, the forward abutment face being provided as a distance piece 3 which together with a stopper ring 13 determine the total distance L0 which the striker means 2a is allowed to travel when the tip lt of the head 1 strikes the target. The other abutment face for the coiled spring 7 is defined by the locking piece 4 which has a rearward outer shape 4a of reduced diameter, conforming to the inner shape of the recess 5a of the detonator housing 5, to allow for said second travelling distance L2 of the time delay element 10 when this is released for travelling by the turned down position of the safeguarding means 8.

The safeguarding means 8 is in the illustrated embodiment made so as to rotate the detonator housing 5 about the transverse axis X2 of the projectile, so as to be rotated 90° from a first time delay element safety position when the safeguarding means 8 is in its safety on position, as illustrated in FIG. 4, and to a second open position when the safeguarding means 8 is rotated from its safety on to its safety off position, thereby allowing the time delay element 10 to be urged into the detonator housing 5 for the locking thereof in an "open" position upon receiving the time delay element 10 which, if preignited by the striker means 2a, will then detonate the detonator 9.

It should be noted that the setting of the ignition time delay element in the range of minimum 2.2 seconds and maximum 3.8 seconds should be larger than the stipulated time for the fired projectile 1 to penetrate into the target, i.e. the time delay should not lapse prior to the release of the safeguarding means 8 from its safety on position to its safety off position, which will occur when the projectile has penetrated deep enough into the target for the triggering of the safeguarding means 8, and so far into the body of the whale that the total main charge can be exploded well under the blubber of the whale.

The sequential preparation of the arrow for the shooting thereof from a darting gun as well as the sequential firing of the firing chain will be explained in the following.

The firing mechanism as well as the main charge is packed and stored in separate packages, and can in a simple manner be mounted, or possibly dismounted if the arrow is not to be fired. If whaling is to occur, the arrow is put in position in the barrel of the darting gun or shooting weapon, and the transport security pin 15 is removed immediately before the triggering of the gun.

When the gun has been triggered, the projectile will follow its trajectory to the whale, into which it will plunge and penetrate underneath the blubber of the whale. When the front of the projectile hits the target, the striking force of the projectile will break the safety pin 14 so as to allow the striker means 2a to be thrown against the ignition time delay element 10 which has a setting of maximum 3.7 seconds. Upon further penetration of the projectile into the whale body the safeguarding means 8 will be hit by the surface of the whale with such a force that the breaking device 8a will disrupt, so that the hoop-like safeguarding means 8 will be moved to a position merging with the outer surface of the projectile to render minor penetration resistance to the projectile during its further penetration into the whale body. Upon triggering of the safeguarding means 8 the detonator housing 5 is turned approximately 90 degrees so as to allow the time delay element 10, which has already been ignited, to enter into the recess 5a of the detonator housing 5 by means of the coiled spring 7 for locking the detonator housing 5 in an "open" position ready for detonation of the detonator 9. This entails that the detonator 9 after the lapse of 3.7 seconds will be detonated, which accordingly will detonate the main charge 10*a*, 11*b* in the tubular body 1*a* attached to the rear of the front head 1.

If the detonator housing 5 is rotated before the time delay element 10 is ignited, the striker means 2*a* will not reach the ignition time delay element 10 for the ignition thereof, which entails that no premature detonation can occur in this instance.

Figure 6:
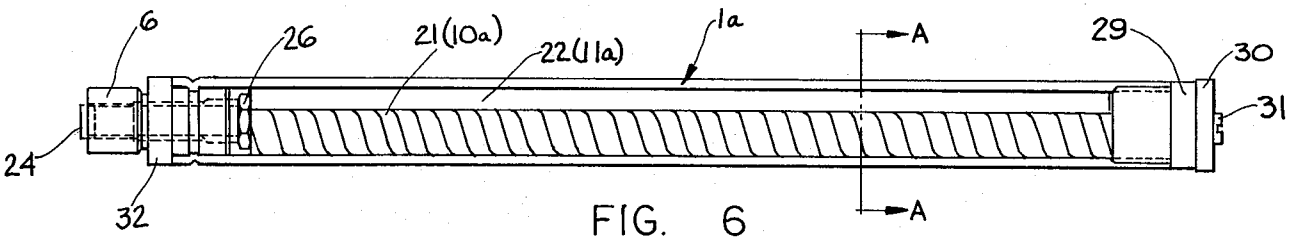
FIG. 6 is a longitudinal section through the tubular body carrying the explosive charge.
Figure 7:
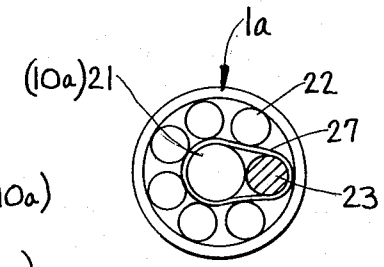
FIG. 7 is a section taken along the lines A—A of FIG. 6.
Figure 6A:
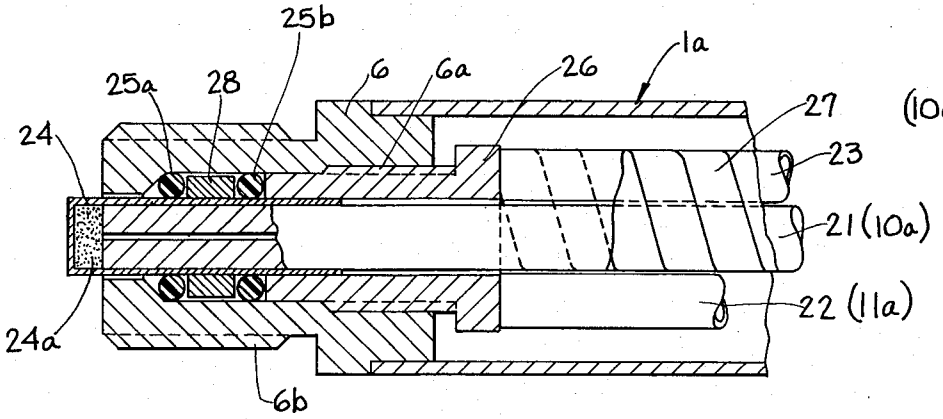
FIG. 6*a* is an enlarged section of the front end of the tubular body.

In FIG. 6, 6*a* and 7 which illustrate in further details a pre-ferred embodiment of a tubular body la, the arrangement of the explosive charges are such that it is avoided that the explosive charge is compressed unduly during firing of the projectile. If the detonating fuse contains an explosive powder which may easily be compressed when subjected to the launching shock of the projectile, for example "Penetrite", or PNTE, it would be appropriate to arrange the detonating fuses in such a manner that compression of the powder is reduced to a minimum, and at least to such a degree that failure of deto-nation is avoided.

As appearing from FIG. 6, 6*a* and 7 the tubular body 1*b* houses a central longitudinally extending detonating fuse 21 (10*a*), surrounded by six outer detonating fuses 22 (11*a*), and a stiff, cylindrical rod 23, for example of aluminium.

Upon assemblance of the composed explosive charges 10*a*, 11*a*, a cap 24 is filled with loose detonating powder 24*a*, for example PNTE, up to for example 3–4 mm. The central detonating fuse 1 is thereafter cut to an appropriate length, for example 263 mm, whereafter the cap 3 is threaded upon the front end of the detonating fuse 21 and is affixed thereto in a squeezing tool. This assembly is thereafter mounted in the connection piece 6 by means of a first joining ring 25*a*, a distance piece 28 a second joining ring 25*b*, and a threaded nut 26 fitting into an internal threaded portion 6*a* of the connection piece 6.

The compound connection piece 6 is thereafter by its front threaded portion 6*b* placed in a jig, in which the nut 26 is tightened so as to bring the joining rings 2*a*, 2*b* in squeezing engagement with the cap 24. The aluminium rod 23 is thereafter brought in contact with the connection piece 6 via the nut 26, and is affixed to the central detonating fuse 21 by means of an appropriate tape 27, which is spirally wound therearound.

Next, the six outer detonation fuses 22, each having an appropriate length, are attached to the preassembled central fuse 21 and aluminium rod 23, for example by means of tape, and thereafter the tubular body 1*b* is mounted around said assembled elements, and is affixed to the connection piece 6 by appropriate adhesion and machining and subsequent polishing. Thereafter, a plug 29 is inserted into the rear end of the tube 1*a*, and a gasket 30 and an end screw 31 will make a sealed termination of the explosive finished grenade. A marking strip 32 can be afixed on the connection piece 6, having a series number printed thereon for identification purposes. The grenade is now ready for being stored apart from the projectile head 1, or for being attached thereto, the attachment being provided by the front threaded portion 6*b* of the connection piece 6 being screwed into the rear internally threaded portion lrr of the front head 1.

Because of the stiffened and separate structure la described above, the explosive charges 10*a*, 11*a* as such can be stored safely from the detonator before use, but render a reliable and appropriate functioning when the projectile is armed and fired.

As indicated on FIG. 5, in which the connection piece 6 has been screwed into the rear end of the front head 1, the front end of the cap 24 containing the loose powder 24*a*, abuts against the whole rear surface of the detonator 9. Upon detonation of the detonator 9, the tongue of flame therefrom will penetrate the thin wall of the cap 24, and since the front end of the cap is filled with loose detonating powder, this powder will most surely be ignited by said tongue of flame, and consequently detonate the PNTE of the central main charge 10*a* which in turn will detonate the remaining main chare 11*a*.

The safety mechanisms provided by the present projectile for a darting gun can be itemized as follows:

1. The possibility of separating the ignition mechanism and the main charge during storing and transport.
2. Transport security pin with the possibility of resecuring after safety removal.
3. There is provided safety pin in the ignition plunger with its striker means.
4. There is provided safety pin for securing the safeguarding means in its safety on position.
5. First detonator protection including the barrier (L2) between the ignition mechanism and the main charge upfiring, it being understood that the detonator housing with the safeguarding means in the safety on position protects the detonator from being detonated, even if the ignition mechanism is triggered prematurely.
6. Second detonator protection including the barrier (L1+L2) between the ignition striker means and the ignition time delay element upon unintentional premature rotation of the detonator protection.
7. Special precaution for avoiding displacement and misfiring of the explosive charge in the projectile due to accelerating forces during firing of the darting gun.
8. Special precaution to ensure safe firing of the detonating charge by the tongue of flame from the detonator.

We claim:

1. In a projectile for a darting gun, said projectile comprising a front head housing a front ignition plunger arranged for axial rearward movement when the tip of the projectile strikes the target, said ignition plunger communicating with rearwardly extending striker means which in an uninfluenced position of said ignition plunger terminates at a first predetermined distance from an ignition time delay element, said ignition time delay element when triggered by said striker means being arranged to fire a detonator which in turn detonates a main charge arranged in a tubular body attached to the rear of said front head, the improvement comprising a safeguarding means adapted to take two positions:

a first position for holding said ignition time delay element at said first distance (L1) from said ignition plunger striker means to allow said striker means to reach said time delay element when said ignition plunger strikes a target, and for holding said ignition time delay element at a second distance (L2) from said detonator to avoid detonation of said detonation of said detonator if said ignition time delay element should be triggered;

a second position for allowing said ignition time delay element to travel said second distance (L2) to reach the detonator;

the sum of said first distance (L1) and second distance (L2) being longer than the total travelling distance (L0) of said ignition plunger striker means.

2. The improvement claimed in claim 1, including a safety pin at the front of said projectile head for keeping said ignition plunger and said striker means in a safe position, said safety pin being dimensioned so as to be broken when said projectile hits a target.

3. The improvement claimed in claim 1, including means for controlling said time delay element relative to said safeguarding means comprising a coiled spring arranged axially in said head and surrounding said ignition time delay element between abutment faces.

4. The improvement claimed in claim 1, wherein said safeguarding means is provided with a breaking device holding said safeguarding means in its safety on position, said breaking device being rupturable by said safeguarding means.

5. The improvement claimed in claim 1, wherein said projectile is provided at its rearward end with an intermediate piece adapted for detachable mounting of said projectile with said tubular body carrying a main charge.

6. The improvement claimed in claim 1, wherein said detonator is mounted for rotation in a housing about an axis transverse to the central axis of said projectile, so as to be rotated from a first to a second position when said safeguarding means is moved from said first to said second posi-tion, thereby allowing said ignition delay element to be urged into a recess in said detonator housing for the locking thereof in a position ready for detonation.

7. The improvement claimed in claim 1, wherein the setting of said ignition time delay element is longer than the stipulated time for the fired projectile to penetrate into said target.

8. The improvement claimed in claim 1, wherein said safeguarding means comprises a hoop-like element protruding sideways from the outer surface of said projectile in said first position, so as to be rotated to its second position when said projectile penetrates into the body of a target, said hoop-like element in said second position merging with the outer surface of said projectile so as to render minor penetration resistance to said projectile during its further penetration into said target.

9. The improvement claimed in claim 8, wherein said safeguarding means is mounted rearwardly of said front ignition plunger, whereby said ignition plunger will be influenced prior to said safeguarding means if this is in its first position when the projectile head hits the target and penetrates thereinto, so that said ignition time delay element is triggered before said safeguarding means is moved from its first position to its second position.

10. Projectile for a darting gun, comprising:

a front head housing a front ignition plunger arranged for axial rearward movement (L0) into a front head housing, and carrying a rearwardly extending striker means;

an ignition time delay element communicating with an urging means and a detonator housing carrying a detonator, said detonator housing being arranged for rotation about an axis transverse to the longitudinal axis of said front head housing;

a safeguarding means attached to said detonator housing and being arranged to take two positions:

a first position for holding said detonator housing in a position preventing the travel of said ignition time delay element, and a second position for allowing said ignition time delay element to travel into said detonator housing through a recess formed therein;

and a tubular body releasably attached to said front head housing and carrying explosive charges.

11. Projectile as claimed in claim 10, wherein said longitudinal tubular body housing said explosive charges comprises a front connection piece which can be attached to said projectile front head upon arming of the darting gun.

12. Projectile as claimed in claim 10, wherein the explosive charges comprises a plurality of longitudinally extending cylindrical detonating fuses, in combination with a cylindrical metal rod attached to one or more of said detonating fuses.

13. Projectile as claimed in claim 12, wherein said tubular body carrying said explosive charges houses a first inner central longitudinally extending detonating fuse, surrounded by a plurality of second outer detonating fuse, and a stiff, cylindrical rod of metal, said metal rod being attached to said central detonating fuse.

* * * * *